United States Patent [19]

Carlson

[11] 4,078,782

[45] Mar. 14, 1978

[54] RANGE JAWS FOR MILLING MACHINE VISES

[76] Inventor: Alfred J. Carlson, 9926 W. 143rd Pl., Orland Park, Ill. 60642

[21] Appl. No.: 821,479

[22] Filed: Aug. 3, 1977

[51] Int. Cl.[2] ..... B25B 1/24

[52] U.S. Cl. ..... 269/283

[58] Field of Search ..... 269/271, 279–284

[56] References Cited

U.S. PATENT DOCUMENTS

| | | | |
|---|---|---|---|
| 2,490,843 | 12/1949 | Sordi | 269/279 |
| 2,770,156 | 11/1956 | Brettrager | 269/283 |
| 3,502,319 | 3/1970 | Kazolias | 269/280 |

*Primary Examiner*—Robert C. Watson
*Attorney, Agent, or Firm*—Farkas, Robert D.

[57] ABSTRACT

An accessary apparatus for vises utilizes a pair of accessory members, one of which has a Z shaped cross-section and means to removably secure the Z shaped cross-section to the stationary non movable portion of the vise. The other accessary member is provided having an L-shaped portion and means to secure the other accessary member to the movable portion of the vise. The L-shaped access member is adapted to have one leg thereof reside on the uppermost portion of the vise. The uppermost surface of the leg of the L-shaped member is provided with a pair of notches adapted to slidably lockingly engage a bar therewithin. The Z shaped member has an upwardly protruding leg extending parallel to the clamping face of the stationary member of the vise. Work is clamped between the upwardly extending leg of the Z shaped member and a surface of the bar when engaged within the notch. Thus, the work piece hangs over a portion of the stationary member and a portion of the movable member of the vise. By moving the bar into the other notch the range of the vise may be extended. Work pieces may also be clamped within the legs of the accessory devices so as to utilize the original range of motion of the vise. Ordinary vises may be utilized with the accessory apparatus so as to extend the clamping range of the vise in the vicinity of twice the normal clasping distances accepted by the vise without the accessory apparatus.

4 Claims, 2 Drawing Figures

RANGE JAWS FOR MILLING MACHINE VISES

BACKGROUND OF THE INVENTION

1. The Field of the Invention

The present invention relates to vises and accessory apparatus utilized therewith, and more particularly to that class of accessory devices which permits work pieces to be clamped by the vise along a dimension thereof greater than the normal open maximum open jaw dimension of the vise not equipped with the accessories.

2. Description of the Prior Art

The prior art abounds with vises utilized to successfully clamp work pieces within the vise mechanism such that the work pieces may have varied dimensions otherwise not easily clamped in between the stationary and movable jaws of the vise. U.S. Pat. No. 3,184,228, issued on May 18, 1965 to E. Z. Chenette et al teaches a movable device which may be installed to the stationary jaw of a vise such that work pieces may be clamped between the stationary jaw accessory and the movable jaw thereof.

U.S. Pat. No. 294,736, issued on Mar. 4, 1884 to H. A. Hyle teaches a movable element adapted for insertion within both mating jaws of a vise. Each movable element is provided with surfaces that are contoured, such surfaces extending along the width of the device and adapted to effectively clamp thereinbetween various shapes of work pieces.

Both of the aforementioned patents suffer the common deficiency of utilizing movable elements whose principal purpose is adapted to effectively clamp work pieces whose clamped dimension is well within the range of stroke of the movable jaw element of the vise. Thus, work pieces whose clamp dimension exceeds the movable stroke of the vise may not be effectively clamped by the vise.

SUMMARY OF THE INVENTION

A primary object of the present invention is to provide an accessory apparatus for conventional vises such that work pieces whose clamped length exceeds the stroke range of the vise may be adequately grasped by a vise mechanism having the accessory element fastened thereto.

Another object of the present invention is to provide an accessory apparatus for vises which permits the vise to clamp effectively work pieces whose clamping dimension is within the stroke length of the vise when the accessory devices are fitted to and fastened onto the vise apparatus.

Still another object of the present invention is to provide a vise which may be fitted with accessory clamping devices such that the vise may be closed down onto a work piece having a clamping thickness of any dimension up to the extended maximum clamping range of the vise.

Yet another object of the present invention is to provide an accessory apparatus for a vise which may be easily and conveniently installed on existing vises and, when removed, permits such vises to be utilized in their conventional fashion.

A further object of the present invention is to provide an accessory apparatus for vises which are inexpensive to manufacture and particularly suited for the purpose for which they are intended.

Heretofore, vises, of conventional design, were utilized to clamp between the stationary and movable jaw elements thereof, work pieces having a clamping dimension extending from zero thickness up to a maximum thickness substantially equal to the range of motion of the movable elements of the vise. Thus, a lead screw was usually provided having a free length extending for the maximum moving range of the movable element of the vise. Work pieces which had a greater length than the stroke of the vise were required to be clamped on the bed of a machine tool, such as a milling machine, without utilizing a vise, because such vises simply did not have the clamping capacity to effectively clamp the clamping dimension of the work piece, or, in some cases, vises were utilized whose weight was excessive in order to easily clamp up the clamping dimension of long work pieces. The present invention eliminates these problems by taking a conventional vise, having a stationary element and a movable element, such that the movable element is provided with a rectangular block-like end having a vertically aligned clamping face and an upper face extending substantially normal thereto. Accessory devices are mounted to the movable jaw and the stationary jaw of the vise. The stationary accessory includes an apparatus having a Z shaped cross-section, such that one leg thereof fastens to the clamping face of the stationary jaw and an upwardly extending leg extending outwardly from the clamping face of the stationary jaw and upwardly therefrom. The upwardly extending leg may have a notch disposed therein, such that the notch is at the end of the upwardly extending leg adjacent to the leg which may be removably secured to the clamping face of the stationary jaw. The other accessory apparatus comprises an accessory apparatus having an L-shaped cross-section. One leg of the L-shaped cross-section is removably secured to the clamping face of the moving element, whilst the other leg of the L-shaped cross-section resides on the upper lateral face of the movable element of the vise. A bar is provided having a truncated projection extending along the elongated length thereof, two or more grooves are provided in the upper face of the leg fastened to the upper surface of the movable elements of the vise. The screws have a complementary shape to the conical truncated projection such that the bar may be inserted into the grooves and is not movable along the upper surface of the upper leg attached to the movable elements of the vise. Work pieces may be clamped between the upwardly extending leg of the accessory element fitted to the stationary jaw of the vise and the bar. The bar may also be provided with a groove extending along its length, wherein the groove is located at an upper surface of the bar when the bar is installed with the L-shaped element. Work pieces may be inserted into the clamping faces of the vise when the vise is devoid of the accessory apparatus. When the vise is equipped with the accessory apparatus work pieces may be installed within the legs of the accessory element fastened to the faces of the vise, or between the upwardly projecting leg of the Z shaped element and the bar fitted to the L shaped element. If it is desired, the end of the work piece may be installed into the notches disposed on the upwardly extending leg on the Z shaped piece and the notch in the bar, thus providing clearance between the body of the work piece and the accessory elements clamping it to the vise.

The accessory members may be secured to the movable and stationary jaws of the vise utilizing threaded holes in the legs of the accessory pieces designed to abut the clamping faces of the vise in which threaded machine screws are installed, wherein the threaded machine screws pass through horizontal holes drilled into the movable element of the vise and the stationary element in the vise. Thus, the accessory elements can be conveniently removed or left permanently attached to the vise. The range of use of a vise equipped with the accessory elements may be easily doubled or quadrupled at will by simply extending the length of the L-shaped member or the length of the Z shaped member between the legs thereof so as to permit work pieces having virtually any clamping dimensions utilized with a vise having only a short stroke. The accessory elements, including the bar, may be fabricated from the suitable metallic material, such as steel or the like, or may, if desired, be fabricated from a non-metallic material, such as a polypropylene plastic, when utilized to clamp together delicate work pieces, such as wood or plastic materials.

DETAILED DESCRIPTION OF THE PREFERRED EMBODIMENT

Figure 1:
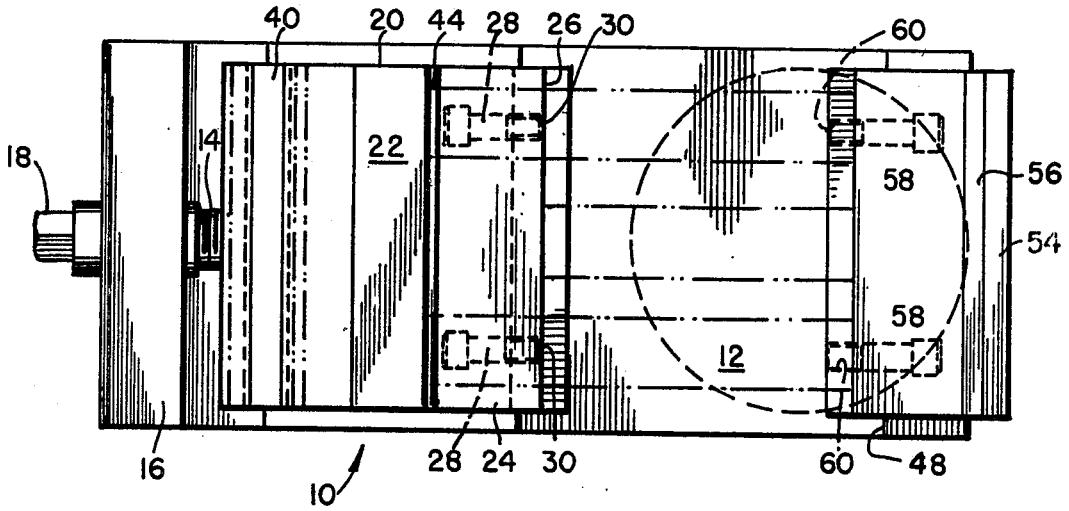
FIG. 1 illustrates a plan view of a vise equipped with the present invention.
Figure 2:
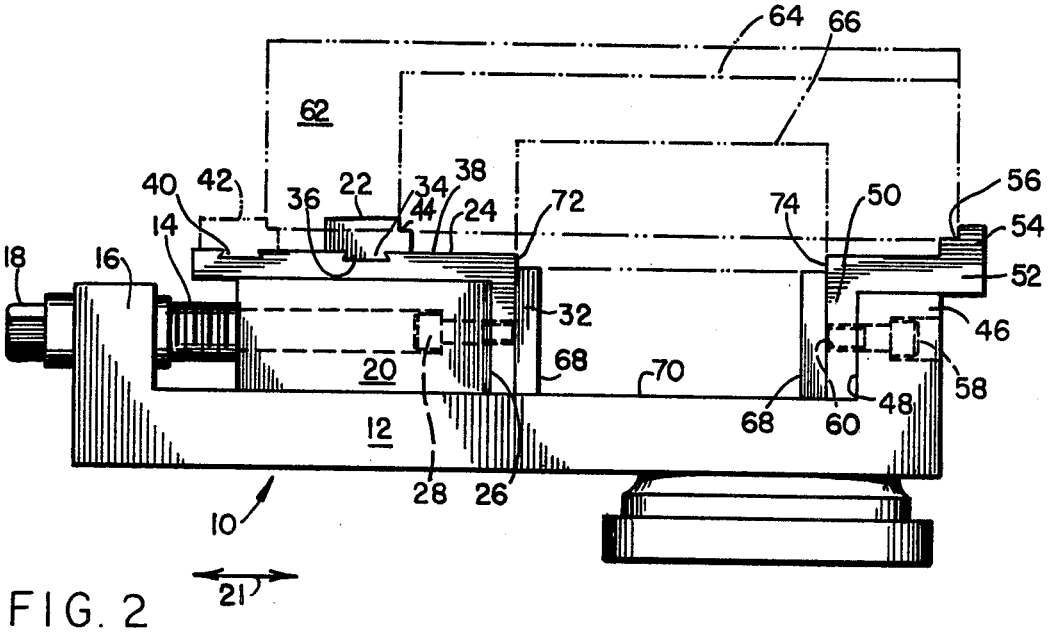
FIG. 2 illustrates a side-elevational view of the apparatus depicted in FIG. 1.

Turning now descriptively to the drawings in which similar reference characters denote similar elements throughout the several views, FIGS. 1 and 2 all illustrate a vise apparatus 10 having a frame member 12 on which is installed a lead screw 14 passing through an end anville member 16 and having a free end 18 of hexagonal shape, adapted for use with a tool having a hexagonal opening therein. The tool, not shown, when installed on hexagonal end 18 and rotated so as to cause end 18 and lead screw 14 to rotate causes movable block 20 to move in the direction of arrows 21 dependent upon the rotation of end 18. Bar 22 is shown installed on L-shaped accessory member 24. The L-shaped accessory member is fastened to clamping face 26 of movable element 20, by utilizing screw 28 engaging threaded holes 30 located in leg 32 of L-shaped member 24. Bar 22 has truncated conical projection 34 installed in a truncated conical groove 36 located in the uppermost surface 38 of leg 24. Another truncated conical groove 40 is installed on surface 38 of leg 24 in which bar 22 may be secured thereto, as illustrated by dotted lines 42. The bar is provided with notch 44 extending along an uppermost corner thereof located adjacent to stationary jaw 46. Clamping face 48 is provided engaging one leg 50 of Z shaped accessory member 52. Upwardly projecting leg 54, of Z shaped member 52, is provided with an elongated notch 56. Screws 58 engage threaded holes 60 located in the leg 50 of the Z shaped member. p In use, bar 22 may have its projection 34 installed in notch 36, or installed in notch 40, displacing bar 22 into the position shown by dotted lines 42. In such position a work piece, depicted by dotted lines 62 may be installed between notches 38 and 56. It is to be noted that the clamping dimension of the work piece, shown by dotted lines 62 extends beyond the range of motion of movable element 20 of the vise 10.

If desired, bar 22 may be installed to leg 24 such that projection 34 is installed in notch 36. In such a position, a work piece, depicted by dotted lines 64 may be installed between grooves 38 and 56. It should be noted that the clamping dimension of the work piece depicted by dotted lines 64 also has a clamping dimension in excess of the maximum open jaw dimension of vise 10. Vise 10 has an open jaw dimension defined by the maximum distance in which surface 26 may be displaced from surface 48.

A work piece, depicted by dotted lines 66, having a clamping dimension less than the work pieces depicted by dotted lines 62 and 64, may be supported on pivotable blocks 68, and clamped between legs 50 and 26. If desired a work piece may be nestled down onto surface 70 of frame 12, wherein pivotable blocks 68 would not be utilized. Naturally, face 72, of L-shaped element 24 and face 74, of Z shaped element 52, may be brought together by judicious rotation of end 18. Thus the vise, fitted with the accessory apparatuses 24 and 52, may be utilized to clamp together work pieces having a virtually zero thickness clamping dimension to a clamping dimension determined only by the length of L-shaped element 24 and the location of notch 56 on the Z shaped element 52.

One of the advantages of the present invention is an accessory apparatus for conventional vises such that work pieces whose clamped length exceeds the stroke range of the vise may be adequately grasped by a vise mechanism having the accessory element fastened thereto.

Another advantage of the present invention is an accessory apparatus for vises which permits the vise to clamp effectively work pieces whose clamping dimension is within the stroke length of the vise when the accessory devices are fitted to and fastened onto the vise apparatus.

Still another advantage of the present invention is a vise which may be fitted with accessory clamping devices such that the vise may be closed down onto a work piece having a clamping thickness of any dimension up to the extended maximum clamping range of the vise.

Yet another advantage of the present invention is an accessory apparatus for a vise which may be easily and conveniently installed on existing vises and, when removed, permits such vises to be utilized in their conventional fashion.

A further advantage of the present invention is an accessory apparatus for vis es which are inexpensive to manufacture and particularly suited for the purpose for which they are intended.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. In the combination of a vise, the vise having a stationary end member and a movable end member, the movable end member having a flat elongated upper surface, the flat elongated upper surface being substantially normal to a work piece clamping surface located on the movable end member, the improvement comprising a first accessory member, a second accessory member, the first accessory member having a Z shaped cross-section, the Z shaped cross-section of the first accessory member having one leg including a notch therein, the notch located in the end of said one leg of the first accessory member adjacent to the other leg of the first accessory member, the second accessory member having an L-shaped cross-section, one leg of the second accessory member adapted to rest upon the upper lateral surface of the movable element of the vise, a pair of grooves formed into said one leg of the second accessory member, a bar, the bar having a projection extending along the length thereof, the projection of the bar having a complementary cross-sectional shape to the cross-sectional shape of the grooves, the bar having an elongated groove therein located adjacent to a corner of the bar, means to removably secure the first accessory member to the stationary member of the vise, means to removably secure the second accessory member to the movable element of the vise.

2. The apparatus as claimed in claim 1 wherein said fastening means for said first accessory member comprises at least one tapped hole extending in the other leg of the first accessory member.

3. The apparatus as claimed in claim 1 wherein the fastening means for fastening the second accessory member comprises at least one tapped hole formed into the other leg of the second accessory member.

4. The apparatus as claimed in claim 1 wherein each of said grooves in said one leg of said second accessory member has a cross-sectional shape defining a truncated cone, said projection having a truncated conical shape, toe portion of said projection adjacent said bar having a narrower width than the portion of said projection located outwardly from said bar.

* * * * *